United States Patent [19]

Myers

[11] 4,234,116

[45] Nov. 18, 1980

[54] ADJUSTABLE CARRIER

[76] Inventor: Daniel J. Myers, 89-15 92nd St., Woodhaven, N.Y. 11421

[21] Appl. No.: 29,668

[22] Filed: Apr. 13, 1979

[51] Int. Cl.[3] ..... A45F 5/02

[52] U.S. Cl. ..... 224/250; 224/267; 224/58

[58] Field of Search ..... 224/250, 904, 252, 253, 224/907, 182, 191, 267, 219, 221, 164, 176, 178, 255; 58/104, 105; 24/264 R, 3R

[56] References Cited

U.S. PATENT DOCUMENTS

| | | | |
|---|---|---|---|
| D. 203,101 | 12/1965 | Holder | 224/252 X |
| 792,126 | 6/1905 | Freund | 224/250 |
| 1,318,850 | 10/1919 | Young | 224/252 X |
| 1,320,934 | 11/1919 | Schopp | 224/250 X |
| 2,186,191 | 1/1940 | Beckwith | 224/250 |

FOREIGN PATENT DOCUMENTS

| | | | |
|---|---|---|---|
| 505650 | 12/1954 | Italy | 224/176 |
| 77852 | 1/1951 | Norway | 58/105 |
| 84085 | 2/1920 | Switzerland | 58/105 |

*Primary Examiner*—Robert J. Spar
*Assistant Examiner*—Jerold M. Forsberg
*Attorney, Agent, or Firm*—Brumbaugh, Graves, Donohue & Raymond

[57] ABSTRACT

An adjustable carrier in which an elongated band is threaded to a belt-mounted support to provide an adjustable inner span which cooperates with the support to hold an article therebetween and in which the ends of the band are detachably coupled to permit adjustment of the intermediate span and to lock it in tightened condition.

4 Claims, 4 Drawing Figures

ADJUSTABLE CARRIER

This invention relates to a carrier for carrying various articles, such as portable radios, flashlights, tools, and the like, on the person.

Some occupations require various articles to be carried on the person so that they are available on the job. For example, policemen may carry portable radios, flashlights and other articles. Electricians may carry various tools and testing equipment. It is not always practical to carry these articles in hand or in separate cases or containers.

The present invention provides a novel carrier which can be adjusted to accommodate various articles to be securely carried on the person. The carrier of the present invention includes a support and an elongated band adjustably coupled with the support to a pair of vertically extending band engaging members so that when the band is threaded with these members the intermediate span of the band cooperates with the support to secure the article in the carrier. When the ends of the band are detached, the intermediate span of the band can be tightened or loosened. When the intermediate span is tightened to secure the article in the carrier, the tightened condition can be maintained by locking the ends of the bands together.

In a preferred embodiment of the invention, the support is provided with a horizontal slot to permit it to be engaged with and worn on a belt. The elongated band is preferably adjustably coupled with the opposite ends of a rigid loop secured within the support. The free ends of the band preferably have interlocking surfaces for attaching them in overlapping relation.

Figure 1:
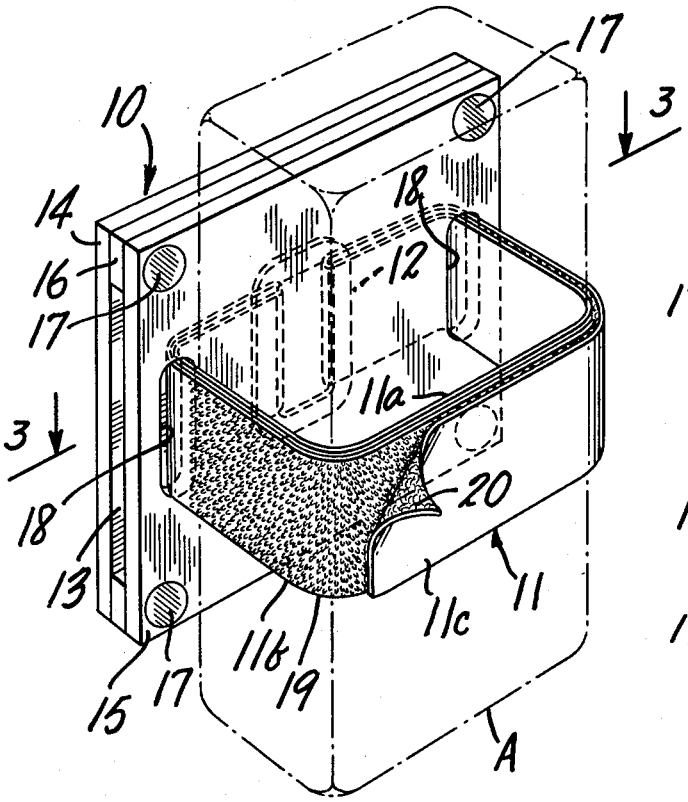
Figure 2:
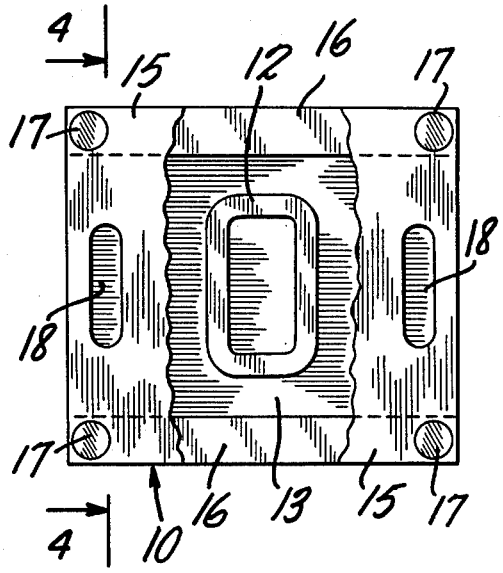
Figure 3:
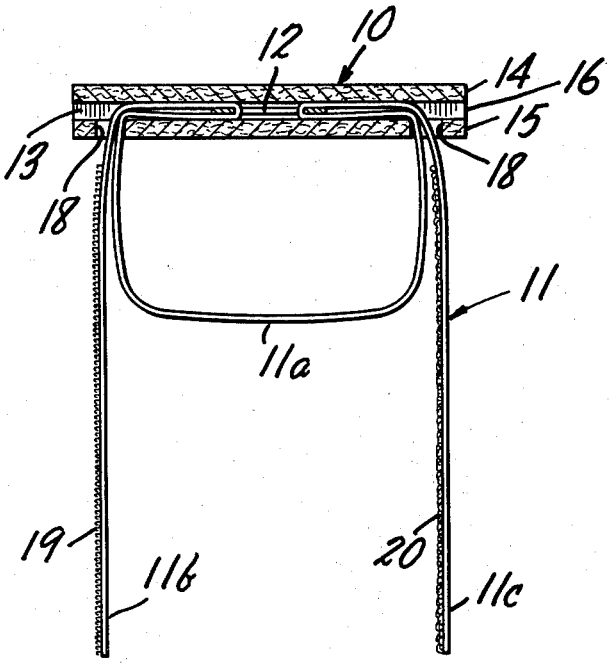
Figure 4:
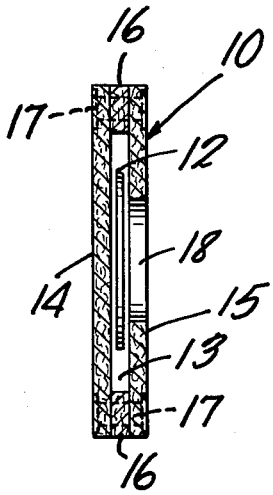

For a full understanding of the present invention, reference should be made to the detailed description which follows and to the accompanying drawings, in which:

FIG. 1 is a perspective view of the carrier of the present invention with an article secured therein shown in phantom lines;

FIG. 2 is an elevational view of the support with an intermediate portion of the front wall broken away; and FIGS. 3 and 4 are sectional views along the lines 3—3 of FIG. 1 and 4—4 of FIG. 2, respectively, looking in the direction of the arrows.

The carrier includes a support 10, an elongated band 11 adjustably coupled with the support and a rigid loop 12 carried by the support and around opposite ends of which portions of the band intermediate the free ends are threaded to form an intermediate span 11*a* of the band. The intermediate span 11a cooperates with the adjacent surface of the support to provide an adjustable carrier in which an article A, shown in phantom lines in FIG. 1, can be securely held.

The support 10 is provided with a horizontal slot 13 so that it can be worn on a belt. Although the support 10 can be of any suitable design, it is shown in the form of a pair of inner and outer panels of leather 14 and 15, respectively, having upper and lower leather strips 16 sandwiched between them. The panels 14 and 15 and the intermediate strips 16 can be stitched or adhesively bonded, or secured by any other suitable means. In the embodiment shown, they are also held together at the corners by rivets 17.

The front panel 15 of the support contains a pair of spaced apart vertical slots 18 which communicate with the horizontal slot 13 on opposite sides of the loop 12.

The band 11 is threaded through one slot 18, around one vertical leg of the loop 12 and back out the same slot to form the intermediate span 11a. The band then passes through the other slot 18, around the other vertical leg of the loop 12 and out through the same vertical slot 18 in the manner illustrated in FIG. 3.

The article A to be secured in the carrier is inserted between the outer surface of the support 10 and the intermediate span 11*a* of the band. The intermediate span is tightened by pulling the free ends 11b and 11*c* of the band outwardly. When the article has been tightly secured, the free ends of the bands are secured in overlapping relation.

The free ends of the bands can be secured by any suitable means, but they are preferably secured by providing opposite surfaces of the overlapping ends with interlocking naps 19, 20, such as Velcro or Scotchmate hook and loop naps. In this way the one end 11*b* is wrapped around the article and the other end 11*c* is overlapped with it and secured thereto by the application of pressure to interlock the nap surfaces 19, 20. The interlocking surfaces can be readily separated by pulling the end 11*c* away from the end 11b to separate the interlocking nap surfaces.

The carrier of the present invention can be used for various articles, such as portable radios, flashlights, tools and the like. One article can be readily substituted for another by separating the ends of the band and readjusting and retightening the intermediate span 11a.

The carrier has been used effectively for carrying portable radios. Custom made cases for portable radios are expensive. Moreover, they accommodate a particular brand of portable radio and become obsolete when one portable radio is superseded by a new or different model or brand. The carrier of the present invention can be used with any brand or model. If the radio is equipped with a separate earpiece, the earpiece can be separately affixed to the belt or to a shoulder near the wearer's ear by interlocking nap materials, leaving the wearer's hands free.

The invention is shown in a single preferred form and by way of example, and modifications and variations can be made therein without departing from the spirit of the invention. The invention, therefore, is not intended to be limited to any particular form or embodiment, except in so far as such limitations are expressly set forth in the claims.

I claim:

1. An adjustable carrier comprising a support, means for mounting the support to a belt worn by the wearer, said support including a portion exterior to the outer surface of the belt worn by the wearer, an elongated band adjustably coupled with the exterior portion of the support, a pair of vertically extending band-engaging members carried by the support exterior to the outer surface of the belt and around which portions intermediate the free ends of the band are threaded to form an adjustable intermediate span of the band between the members which cooperates with the exterior portion of the support to accommodate an article adjacent said exterior portion and which can be securely held and the span adjusted by tightening the intermediate span with the application of force to the ends of the band, vertically extending slots in the exterior portion of the support and communicating with said pair of vertically extending band-engaging members on opposite sides thereof so that the band can be threaded through the slots and around band-engaging members on opposite sides of the intermediate span of the band, and means for securing the free ends of the bands together to maintain the article in the carrier.

2. An adjustable carrier as set forth in claim 1 in which the means for mounting the support to the belt is a horizontal slot through the support to permit the support to be engaged with and carried by a belt and in which the band-engaging members are accommodated within the horizontal slot between the belt and the exterior portion of the support.

3. An adjustable carrier as set forth in claim 1 in which the band-engaging members are formed by vertically extending legs of a rigid loop carried by the support accommodated between the belt and the exterior portion of the support.

4. An adjustable carrier comprising a support, an elongated band adjustably coupled with the support, a rigid loop having a pair of vertically extending band-engaging legs carried by the support and around which portions intermediate the free ends of the band are threaded to form an adjustable intermediate span of the band between the members which cooperates with the support to accommodate an article which can be securely held by tightening the intermediate span with the application of force to the free ends of the band, means for securing the free ends of the bands together to maintain the article in the carrier, a belt-engaging slot formed horizontally through the support and accommodating the rigid loop therein, a pair of vertically extending slots in a surface of the support and communicating with the horizontal slot on opposite sides of the loop so that the band can be threaded through the slots and around the legs of the loop on opposite sides of the intermediate span of the band.

* * * * *